United States Patent [19]

Ota et al.

[11] Patent Number: 4,499,179

[45] Date of Patent: Feb. 12, 1985

[54] SILVER HALIDE PHOTOGRAPHIC LIGHT-SENSITIVE MATERIAL

[75] Inventors: Hideo Ota; Kiyotoshi Yamashita, both of Hachioji, Japan

[73] Assignee: Konishiroku Photo Industry Co., Ltd., Tokyo, Japan

[21] Appl. No.: 468,398

[22] Filed: Feb. 22, 1983

[30] Foreign Application Priority Data

Feb. 25, 1982 [JP] Japan ..... 57-30393

[51] Int. Cl.[3] ..... G03C 1/78

[52] U.S. Cl. ..... 430/523; 430/950; 430/961

[58] Field of Search ..... 430/950, 961, 523

[56] References Cited

U.S. PATENT DOCUMENTS 4,190,449 2/1980 Naoi et al. ..... 430/539
4,218,533 8/1980 Fuchigami et al. ..... 430/512
4,235,959 11/1980 Thijs et al. ..... 430/531
4,288,521 9/1981 Kojima et al. ..... 430/169
4,343,873 10/1982 Sasaoka ..... 430/1
4,399,213 8/1983 Watanabe et al. ..... 430/523

*Primary Examiner*—Jack P. Brammer
*Attorney, Agent, or Firm*—Frishauf, Holtz, Goodman & Woodward

[57] ABSTRACT

A silver halide photographic light-sensitive element having on a support, at least one silver halide light-sensitive emulsion layer which has thereon a protective layer composed of a binder containing a non-light-sensitive hydrophilic colloid. The protective layer is made up of an outer layer and an inner layer. The outer layer contains oil particles in the form of water-insoluble liquid droplets finely dispersed in the binder and the inner layer contains fine solid particles wherein the ratio of the thickness of the inner layer to the outer layer is at least 1.5.

18 Claims, No Drawings

SILVER HALIDE PHOTOGRAPHIC LIGHT-SENSITIVE MATERIAL

BACKGROUND OF THE INVENTION

The present invention relates to the method to prevent an abrasion on a silver halide photographic light-sensitive material and more particularly to the method for preventing the abrasion marks (desensitization) generated by the contact of the silver halide photographic light-sensitive material with a packing machine, a camera, a processing machine and the like.

A silver halide photographic light-sensitive material holds at least one light-sensitive silver halide emulsion layer on its support made of the material such as paper, glass, cellulose acetate film, polyester film or the like and the surface layer or the outermost layer thereof is normally a non-light-sensitive surface protective layer arranged on the emulsion layer though it sometimes is a light-sensitive silver halide emulsion layer. Such emulsion layer, the surface layer like a protective layer or the outermost layer contain a hydrophilic colloid such as gelatin or the like as a binder.

Such a silver halide photographic light-sensitive material containing gelatin as a binder has a high coefficient of friction against the surface of other metal or the surface of gelatin or the like and its surface is extremely subject to an abrasion caused by the contact, friction or the like. In the silver halide photographic light-sensitive material, in particular, an abrasion especially causes pressure marks, a pressure-desensitization or the like and thus detrimentally affects the photographic image because silver halide to be used as a light-sensitive substance reacts sharply even against the pressure.

Recently, the speed of manufacturing processes such as coating, drying and treatment for the silver halide photographic light-sensitive material has been increased compared with that in the past, the product forms have been diversified, packing machines in the treatment process have been complicated and further in the camera, the compactness thereof and automatic winding and rewinding or the like have been realized and various purposes for application have emerged. Thus the silver halide photographic light-sensitive material is in the tendency wherein it is generally used under the severe condition. Under such circumstances, therefore, the abrasion-resisting qualities and the prevention of the pressure marks (desensitization) of the silver halide light-sensitive emulsion caused by the abrasion are becoming increasingly important.

In a silver halide photographic light-sensitive material, a non-light-sensitive protective layer is usually arranged outside of a light-sensitive emulsion layer and further fine particles of an inorganic material such as silica, titanium dioxide, magnesium oxide or the like or an organic material such as polymethylmethacrylate, cellulose acetate propionate, polystyrene or the like are contained therein for the purpose of matting of the surface thereof and thus the contact area thereof is reduced and thereby the coefficient of friction thereof is controlled and the occurrence of the fog caused by the pressure is prevented. However, these methods tend to cause disadvantages such as impairing the transparency of the light-sensitive material and hurting the sharpness and graininess of images and thereby the amount of usage is naturally limited, which results in a less effect.

There are methods such as the one described in U.S. Pat. No. 3,042,522 wherein dimethylsilicone and a specific surface active agent are contained concurrently in the external layer and thereby a sliding property is given to the light-sensitive material or the one described in U.S. Pat. No. 3,121,060 wherein a high boiling solvent and solid paraffin are added to the external layer after there are dispersed in a gelatin aqueous solution. These methods are attended with undesirable side effects such as the increase in the so-called adhesion property that means an adhesion of films under the conditions of high temperature and high humidity, creating of coating troubles in the manufacturing process of silver halide photographic light-sensitive materials, deterioration of photographic characteristics and the trouble that substances added dissolve in the developer and settle.

Furthermore, in Japanese Patent Publication Open to Public Inspection Nos. 13923/1978, 85421/1978, there are described the methods for causing a silver halide light-sensitive emulsion layer contain a high boiling organic solvent against the pressure marks caused by the external physical pressure such as bending or strong squeezing of silver halide photographic light-sensitive material. In this method, however, a high boiling organic solvent moves to the external layer of the light-sensitive material in its storage under high temperature and high humidity because it has no miscibility with a hydrophilic binder and it has a great influence on the original photographic characteristic of the silver halide light-sensitive emulsion though it is used for the improvement of a physical property.

In the improvement of physical properties of a silver halide photographic light-sensitive material, as stated above, technologies presented in succession create successively the new disadvantages and a vicious cycle seems to be endless due to the complicated latent factors. Therefore, the primary object of the present invention is to provide a silver halide photographic light-sensitive material that is excellent in its abrasion-resisting qualities without impairing the photographic characteristic, transparency and adhesion property. The second object of the present invention is to provide a method for preventing the pressure marks (desensitization) of the silver halide light-sensitive emulsion layer caused by the abrasion without impairing the photographic characteristic, transparency and adhesion property.

SUMMARY OF THE INVENTION

Aforesaid object of the present invention has been attained by the silver halide photographic light-sensitive material having, on the same side of the support thereof, at least one silver halide photosensitive emulsion layer and a non-light-sensitive hydrophilic colloidal layer (protective layer) as the outermost layer composed of two layers, wherein one layer (hereinafter referred to as an upper layer) of said non-light-sensitive hydrophilic colloidal layer that is outside against the support contains oil particles and the other layer (hereinafter referred to as a lower layer) that is inside against the support contains fine particles and the ratio of the thickness of the lower layer of the protective layer to that of the upper layer of the protective layer is not less than 1.5.

The present invention is preferably applied to the finished product of silver halide photographic light-sensitive material characterized in that a non-light-sensitive hydrophilic colloidal layer that protects a silver halide light-sensitive emulsion layer is composed of two layers one of which contains oil particles and the other contains fine particles and the thickness of the lower layer of the protective layer is 1.5 times that of the upper layer of the protective layer or more but it may also be applied to semiprocessed product in the manufacturing process.

Oil particles used in the upper layer of a non-light-sensitive hydrophilic colloidal layer (protective layer) of the present invention mean a liquid droplet particles which are finely dispersed in the binder consisting substantially of hydrophilic colloidal material and which are insoluble in water.

In the present invention, the density of oil particles to be contained in the upper layer of a non-light-sensitive hydrophilic colloidal layer (protective layer) is preferably 0.1–0.4 against the volume of the binder.

Incidentally, the density of oil particles mentioned in the present invention is defined by the ratio of the total volume of oil particles added to the non-light-sensitive hydrophilic colloidal layer to that of the binder contained in said layer.

Oil particles in the present invention consist of, for example, ester (e.g. ester phthalate, ester phosphate, fatty acid ester or the like), amide (e.g. fatty acid amide, sulfonamide or the like), ether, alcohol, paraffin or the like described in U.S. Pat. Nos. 2,322,027, 2,533,514, 2,882,157, Japanese Patent Examined Publication No. 23233/1971, British Pat. Nos. 958,441, 1,222,753, Japanese Patent Publication Open to Public Inspection No. 82078/1975, U.S. Pat. Nos. 2,353,262, 3,676,142, 3,700,454, Japanese Patent Publication Open to Public Inspection Nos. 27921/1976, 141623/1976 and others.

Furthermore, oil particles also include the one which is in solid form at normal temperature but turns to the liquefied form when it is added to and contained in the hydrophilic colloidal layer or when various additives for photographic use are contained therein. For example, stilbene, triazine, oxazole and coumarin compounds which are used as a bleaching agent and benzotriazole, thiazolin and cinnamic acid ester compounds or the like which are used as an ultraviolet rays absorber are given.

Any of the known methods may be used for the formation of oil particles in the present invention and a typical method, for example, is to use the compounds in single or plural kinds which form oil particles of a high boiling organic solvent or the like after dissolving them at need together with additives for the photographic use to be stated later. Further, as occasion demands, said compounds to form oil particles may be dissolved in a low boiling solvent such as methyl acetate, ethyl acetate, butyl propionate, cyclohexanol or the like and then are mixed with an aqueous solution that contains a hydrophilic colloid material like gelatin or the like and contains anion surface active agent such as alkylbenzene sulfonic acid and alkylnaphthalene sulfonic acid and/or nonion surface active agent such as sorbitansesqui oleic acid ester and sorbitanmonolauric acid ester and the mixture thus obtained may be emulsified and dispersed with a colloid mill or a supersonic dispersing apparatus and others and dispersed liquid thus obtained may be added for coating to the coating liquid containing a hydrophilic colloidal material.

Further, a chemical compound that forms oil particles of a certain type may be dissolved in aforesaid low boiling organic solvent and the solution thus obtained may be added directly to the coating liquid containing a colloidal material.

Fine particles contained in the lower layer of the non-light-sensitive hydrophilic colloidal layer (protective layer) in the present invention mean an organic compound or an inorganic compound whose average particle diameter is $0.005\mu$–$5\mu$ and preferably is $0.02\mu$–$3\mu$.

These fine particles include organic or inorganic matting agent, copolymer latex, colloidal silica and others to be used in the industry in the art.

Actual examples as an organic compound include a copolymer of ester of acrylic acid or of methacrylic acid, cellulose acetate propionate, polystyrene and others. Inorganic compounds include silver halide, strontium sulfate, barium sulfate, calcium carbonate, crystalline oxide of $SiO_2$ (silica), ZnO, $TiO_2$, $Al_2O_3$, MgO, BaO or the like or the compound oxides thereof and silver halide includes any one of silver bromide, silver chloride, silver iodobromide, silver chlorobromide, silver chloroiodobromide or the like which are usually used for silver halide photographic emulsion.

Silicon dioxide (silica) is particularly preferable as fine particles in the present invention and alumina or sodium aluminate may be contained therein as a minor ingredient. Further, fine particles include colloidal silica dispersed in water with a primary dispersion medium of water and they further include the one wherein inorganic salt such as sodium hydroxide, lithium hydroxide, ammonium hydroxide or the like or organic salt such as tetramethylene ammonium ion are contained in the colloidal silica as an alkaline ingredient and as a stabilizer.

The amount of fine particles to be used in the present invention, though there is no limitation in particular, is preferably 3–50% against the weight of gelatin in the lower layer of the non-light-sensitive hydrophilic colloid layer (protective layer) that contains fine particles and is preferably 0.02–0.5 $g/m^2$ as a coating amount.

With regard to the layer thickness of the non-light-sensitive hydrophilic colloidal layer (protective layer) consisting of two layers in the present invention, the total layer thickness is not limited in particular.

As a hydrophilic colloidal material used as a binder in a non-light-sensitive hydrophilic colloidal layer consisting of two layers in the present invention, there may be used gelatin and derivative gelatin such as phthalated gelatin or malonated gelatin and it is also possible to use albumin, agar-agar, gum arabic, alginic acid, casein, partially hydrolyzed cellulose derivative, polyvinyl alcohol, partially hydrolyzed polyvinyl acetate, polyacrylic acid, polyacrylamide, polyvinylpyrolidone and a copolymer of vinyl compound of above items, partially or totally in place of the gelatin and derivative gelatin.

The upper layer of the non-light-sensitive hydrophilic colloidal layer (protective layer) consisting of two layers in the present invention constitutes the substantial surface layer of a silver halide photographic light-sensitive material and is allowed to contain a matting agent comprising such an inorganic material as silica, titanium dioxide, magnesium oxide or the like, or such an organic material as polymethyl methacrylate, cellulose acetatepropionate, or the like, and further also allowed to contain a dispersed colloidal silver, and still further allowed to contain a substantially not developed fine-grained silver halide as described in, e.g., U.S. Pat. Nos. 3,050,391 and 3,140,179. In addition, the lower layer of the protective layer may also contain the same oil particles as contained in the upper layer of the protective layer.

The non-light-sensitive hydrophilic colloidal layers in the present invention may be hardened by the use of any of known hardening agents. Examples of such hardening agents include ketone compounds such as diacetyl, dichloropentanedione and the like, bis(2-chloroethylurea), 2-hydroxy-4,6-dichloro-1,3,5-triazine, compounds containing a reactive halogen as described in U.S. Pat. Nos. 3,288,775 and 2,732,303, and British Pat. Nos. 974,723 and 1,167,207, divinyl sulfone, 5-acetyl-1,3-diacryloylhexahydro-1,3,5-triazine, and compounds as described in U.S. Pat. Nos. 3,635,718 and 3,232,763, British Pat. No. 994,869, and U.S. Pat. Nos. 2,732,316, 2,586,168, 3,103,437, 3,117,280, 2,983,611, 2,725,294, 2,725,295, 3,100,704, 3,091,537, 3,321,313 and 3,543,292.

For the formation of the hydrophilic colloidal layers, surface active agents may be added singly or in combination to a coating liquid. These surface active agents serve as a coating aid or serve to improve the emulsification-dispersibility as well as sensitometric characteristics, and also as an anti-static agent or an anti-adhesion agent. These surface active agents include natural surface active agents such as saponin; nonionic surface active agents such as alkylene oxide type compounds, glycerol type compounds, glycidol type compounds, and the like; cationic surface active agents such as higher alkylamines, quaternary ammonium salts, pyridine, other hetero compounds, phosphonium salts and sulfonium salts; anionic surface active agents such as carboxylic acid, sulfonic acid, phosphoric acid, compounds containing acidic groups such as sulfate, phosphate, and the like; and amphoteric surface active agents such as amino acids, aminosulfonic acids, sulfate or phosphate of amino alcohol, and the like. Examples of these applicable surface active agents are partly described in U.S. Pat. Nos. 2,271,623, 2,240,472, 2,288,226, 2,739,891, 3,068,101, 3,158,484, 3,201,253, 3,210,191, 3,294,540, -48-15,649, 3,441,413, 3,442,654, 3,475,174, 3,545,974, West German OLS No. 1,942,665, British Pat. Nos. 1,077,317 and 1,198,450, and the like. The non-light-sensitive hydrophilic colloidal layer may further contain various other additives for photography use.

The light-sensitive material produced according to the present invention has on the support thereof at least one silver halide emulsion layer. These silver halide light-sensitive layer and support, and other auxiliary layers (anti-halation layer, filter layer, interlayer, and sub layer) provided may be any of known ones.

The silver halide used to form the emulsion layer of the light-sensitive material of the present invention is generally in the form of particles of a silver halide dispersed in a hydrophilic colloid. Examples of the silver halide include silver bromide, silver chlorobromide, silver iodobromide, and silver chloroiodobromide. These silver halide can be produced by various known methods including not only an ammonia method, a neutral method, and an acidic method but also a so-called conversion method and a simultaneous mixing method as described in British Pat. No. 635,841 and U.S. Pat. No. 3,622,318.

Hydrophilic colloid in which silver halide may be dispersed can use the same binder as the one used in the non-light-sensitive hydrophilic colloidal layer.

The above-mentioned silver halide emulsion may be chemically sensitized by any usual technique.

Further, the silver halide emulsion may, if necessary, be spectrally sensitized or hypersensitized by using, singly or in combination, cyanine dyes such as cyanine, merocyanine, carbocyanine, and the like, or styryl dyes in combination with the cyanine dyes.

To the photographic emulsion may be added a variety of compounds so as to prevent the deterioration of sensitivity or the occurrence of fogging during the production process, storage or processing of the light-sensitive material. For the above purpose, there have been known a number of compounds including 4-hydroxy-6-methyl-1,3,3*a*,7-tetrazaindene, 3-methylbenzothiazole, 1-phenyl-5-mercaptotetrazole, other heterocyclic compounds, mercury-containing compounds, mercapto compounds, metal salts and the like.

The color photographic light-sensitive material according to the present invention may contain couplers as indicated below:

Open-chain ketomethylene compounds are known to be useful as yellow couplers. In the practice of the invention, benzoylacetanilide type yellow couplers and pivaloylacetanilide type yellow couplers which have been now widely used can be employed. In addition, yellow couplers of the two-equivalent type in which the carbon atom at the coupling position has a substituent capable of freeing therefrom upon coupling reaction are conveniently used. Examples of such couplers are those as described in U.S. Pat. Nos. 2,875,057, 3,265,506, 3,664,841, 3,408,194, 3,447,928, 3,277,155 and 3,415,652, Japanese Patent Examined Publication No. 13576/1974, and Japanese Patent O.P.I. Publication Nos. 29432/1973, 66834/1973, 122335/1974, 28834/1975 and 132926/1975. Magenta couplers usable in the present invention are pyrazolone-type, pyrazolo triazole-type, pyrazolinobenzimidazole-type and indazolone-type compounds. The pyrazolone-type magenta couplers are those as described in U.S. Pat. Nos. 2,600,788, 3,062,653, 3,127,269, 3,311,476, 3,419,391, 3,519,429, 3,558,318, 3,648,514 and 3,888,680, Japanese Patent O.P.I. Publication Nos. 29639/1974, 111631/1974, 129538/1974, 13041/1975 and 105820/1976, and Japanese Patent Application Nos. 134470/1975 and 156327/1975. The pyrazolotriazole-type magenta couplers are those as described in British Pat. No. 1,247,493, and Belgian Pat. No. 792,525. The pyrazolinobenzimidazole-type magenta couplers are those as described in U.S. Pat. No. 3,061,432, West German Pat. No. 2,156,111, and Japanese Patent Examined Publication No. 60479/1971. Further, the indazolone-type magenta couplers are those as described in Belgian Pat. No. 769,116. These compounds are advantageously usable in the present invention.

Cyan couplers for use in the present invention are phenol or naphthol derivatives, examples of which are those as described in, e.g., U.S. Pat. Nos. 2,423,730, 2,474,293, 2,801,171, 2,895,826, 3,476,563, 3,737,316, 3,758,308 and 3,839,044, and Japanese Patent O.P.I. Publication Nos. 3742/1972, 10135/1975, 25228/1975, 112038/1975, 117422/1975 and 130441/1975.

Aside from the above-indicated couplers, colored magenta couplers or colored cyan couplers may also be advantageously used in the present invention.

In practice, the silver halide emulsion layer may contain a so-called DIR compound. Further, the silver halide emulsion layer may also contain arbitrary photographic additives such as a color-fading resistant, an anti-stain agent, and the like.

In the present invention, for the support on which are formed the non-light-sensitive hydrophilic colloidal layer of the invention, the silver halide emulsion layer, and other auxiliary layers, there may be suitably used such materials, for example, a film of a cellulose ester such as cellulose nitrate, cellulose acetate, or the like, a polyester film such as polyethylene terephthalate, polyvinyl acetal film, polyvinyl chloride film, polystyrene film, polycarbonate film, baryta paper, polyethylene-coated paper or the like.

The coating method for the protective layer, silver halide light-sensitive layer and other layers of the light-sensitive material should properly be selected to ensure the uniform quality and high productivity of the product. A suitable coating method can be selected from, for example, dip coating, double roll coating, air knife coating, extrusion coating and curtain coating. Of these, the extrusion coating and curtain coating are specially useful since they enable two or more layers to be coated simultaneously. The coating speed may be arbitrarily determined but it is preferred to be 30 m/min or more in view of productivity.

If it is necessary to use a substance or agent such as a hardening agent which is apt to gel prior to application due to its high reactivity when added to a coating liquid, it is preferable to mix such agent with the coating liquid immediately before the application by the use of a static mixer.

The light-sensitive material according to this invention is suitably applicable for monochromatic, X-ray, printing, micrographic, electron-beam, infrared ray, color and the like recordings.

The present invention will be illustrated in detail by way of the following examples, which should not be construed as limiting the embodiment of the present invention thereto.

In the following examples, pressure marks produced on the silver halide light-sensitive emulsion due to abrasion were evaluated in the following manner:

To the light-sensitive surface of each of unexposed film samples, a load was applied by use of a 0.3 mm stylus head of a sclerometer, and the film sample was then processed according to the following developing process to thereby determine a load to cause pressure marks on the light-sensitive emulsion.

| Developing Process (38° C.) | Processing Time |
|---|---|
| Color development | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |

In the respective processes, the following processing compositions were used.

| | |
|---|---|
| Color Developer: | |
| 4-amino-3-methyl-N—ethyl-N (β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Water to make 1 liter, pH adjusted at 10.0 | |
| Bleaching Bath: | |
| Iron ammonium ethylenediamine-tetraacetate | 100.0 g |
| Diammonium ethylenediamine tetraacetate | 10.0 g |
| Ammonium bromide | 150.0 g |
| Glacial acetic acid | 10.0 g |
| Water to make 1 liter, pH adjusted at 6.0 | |
| Fixing Bath: | |
| Aqueous 50% ammonium thiosulfate solution | 162 ml |
| Anhydrous sodium sulfite | 12.4 g |
| Water to make 1 liter, pH adjusted at 6.5 | |
| Stabilizing Bath: | |
| Aqueous 37% formalin solution | 5.0 ml |
| Konidax (product of Konishiroku Photo Industry Co., Ltd.) | 7.5 ml |
| Water to make 1 liter | |

EXAMPLE 1

A blue-sensitive silver iodobromide emulsion for color photography use (containing 7 mole% silver iodide) was prepared which contains gelatin in the quantity of 300 g per mole of the silver halide, an yellow coupler α-pivaloyl-α-(1-benzyl-2,4-dioxyimidazoline-3-yl-2-chloro-5[γ-(2,4-tert-amylphenoxy)-butylamido]acetanilide in the quantity of $2.5\times10^{-2}$ moles and a hardener 1,2-bis(vinyl-sulfonyl)ethane. Along with this emulsion, the following dispersed liquid A was produced for the preparation of protective layers. For the upper layer of the protective layer there was prepared a mixture of dispersed liquid A, 1,2-bis(vinyl-sulfonyl)ethane, polymethyl methacrylate with mean particle size of 4μ as a matting agent, and sodium di-2-ethylhexyl sulfosuccinate as a coating aid, while for the lower layer there was prepared a mixture of dispersed liquid A, 1,2-bis(vinylsulfonyl)ethane, and saponin as a coating aid. The resulting mixtures were used, mixing with an aqueous gelatin solution as given in Table 1, to prepare coating liquids for both the upper layer and lower layer of the protective layer, respectively. The above-prepared silver halide emulsion layer, the lower layer of the protective layer, and the upper layer of the protective layer were then coated simultaneously in this order from the support side by the slide hopper coating method on a subbing layer-coated cellulose triacetate film support.

The thus obtained film sample was subjected to the aforementioned test for pressure marks due to abrasion, and the results are as given in Table 1.

In addition, as for the thicknesses of the protective layers, in samples No. 1 to No. 4, their upper layers have about 1.8μ and their lower layers have about 0.6μ, while in samples No. 5 to No. 10, their upper layers about 0.6μ and their lower layers about 1.8μ.

Dispersed Liquid A 24 g of dioctyl phthalate and 6 g of ethyl acetate were mixed to be dissolved at 65° C., and the resulting solution was added, with stirring, to 100 cc of aqueous 5% gelatin solution containing 1 g of sodium triisopropylnaphthalene-sulfonate heated to 50° C., and the mixture was dispersed through five-time dispersing operations of a colloid mill, whereby dispersed liquid A having liquid particles consisting of dioctyl phthalate was prepared.

TABLE 1

| Sample No. | | 1 | 2 | 3 | 4 | 5 | 6 | 7 | 8 | 9 | 10 |
|---|---|---|---|---|---|---|---|---|---|---|---|
| Protective Layer Composition | | | | | | | | | | | |
| Upper layer | Binder (gelatin) g/m$^2$ | 2.40 | 2.40 | 2.00 | 1.55 | 0.80 | 0.73 | 0.73 | 0.64 | 0.64 | 0.53 |
| | Amount of oil particles g/m$^2$ in dispersed liquid A | — | — | 0.28 | 0.62 | — | 0.06 | 0.06 | 0.12 | 0.12 | 0.20 |
| Lower layer | Binder (gelatin) g/m$^2$ | 0.80 | 0.80 | 0.80 | 2.40 | 2.40 | 2.40 | 2.40 | 2.40 | 2.40 | 2.40 |
| | Kind of powdery particles | Polymethyl methacrylate with mean particle size of 0.5μ | | | | | | | | | |
| | Amount of powdery particles g/m$^2$ | — | 0.10 | 0.10 | 0.10 | — | — | 0.10 | 0.10 | 0.20 | 0.10 |
| Density of oil particles in the upper layer | | 0 | 0 | 0.19 | 0.54 | 0 | 0.10 | 0.10 | 0.25 | 0.25 | 0.51 |
| Results | Load to cause pressure marks due to abrasion (g) | 3 | 4 | 3 | 5 | 4 | 5 | 14 | 13 | 15 | 10 |

Note:
The above densities of oil particles were calculated on condition that the specific gravity of gelatin is 1.35 and that of the oil component is 1.0.

As apparent from Table 1, samples No. 7 to No. 9 of the invention, as compared to samples No. 1 to No. 6 and No. 10, are remarkably excellent in the resistance against pressure marks due to abrasion.

Two 5 cm-square-size pieces were taken from each of the samples (No. 1 to No. 10) and they were allowed to stand, arranging so as not to cause the pair to be contacted with each other under an atmospheric condition of 23° C. and 80%RH (the RH stands for relative humidity) for 24 hours, and the sample pairs, with their protective layers face to face, were then brought into contact with each other, onto which was applied a load of 800 g, and subsequently stored under an atmospheric condition of 40° C. and 80%RH. After that when each pair was peeld apart, sample pairs No. 4 and No. 10 were found adhering nearly overall to each other. The other samples other than the two pairs showed that the adhered areas thereof fall under the range of from 0 to 20%, and no reverse influence by the samples of the invention upon the surface adhesiveness was observed.

EXAMPLE 2

On a subbing layer-coated cellulose triacetate film support were coated in the order from the support side simultaneously the same blue-sensitive emulsion layer as in Example 1 and the lower layer and the upper layer of the protective layer having the compositions according to Table 2. The results of the obtained film samples tested for pressure marks due to abrasion are as shown in Table 2. In Table 2, the thickness of the upper layers of sample No. 11 to 18 are about 0.6μ and those of lower layers thereof are about 1.8μ.

TABLE 2

| Sample No. | | 11 | 12 | 13 | 14 | 15 | 16 | 17 | 18 |
|---|---|---|---|---|---|---|---|---|---|
| Protective Layer Composition | | | | | | | | | |
| Upper layer | Binder (gelatin) g/m$^2$ | 0.64 | 0.64 | 0.64 | 0.64 | 0.64 | 0.64 | 0.64 | 0.64 |
| | Amount of oil particles g/m$^2$ in dispersion liquid B (*) | 0.12 | 0.12 | 0.12 | 0.12 | 0.12 | 0.12 | 0.12 | 0.12 |
| Lower layer | Binder (gelatin) g/m$^2$ | 2.40 | 2.40 | 2.40 | 2.40 | 2.40 | 2.40 | 2.40 | 2.40 |
| | Kind of powdery particles | $SiO_2$ | $SiO_2$ | $SiO_2$ | $SiO_2$ | $SiO_2$ | $SiO_2$ | $SiO_2$ | $SiO_2$ |
| | Mean particle size (μ) of powdery particles | — | 0.05 | 0.10 | 1.0 | 1.0 | 1.0 | 2.0 | 4.0 |
| | Amount of powdery particles g/m$^2$ | — | 0.40 | 0.40 | 0.05 | 0.15 | 0.30 | 0.15 | 0.15 |
| Results | Load to cause pressure marks due to abrasion | 8 | 21 | 20 | 19 | 22 | 21 | 20 | 20 |

TABLE 2-continued

| Sample No. | 11 | 12 | 13 | 14 | 15 | 16 | 17 | 18 |
|---|---|---|---|---|---|---|---|---|
| (g) | | | | | | | | |

Note (*):
Dispersion liquid B was prepared in the same way of preparing dispersion liquid A in Example 1 except that following compound was used in place of dioctyl phthalate.

$$\begin{array}{l} CH_2-OOC-nC_{11}H_{23} \\ | \\ CH-OOC-nC_{11}H_{23} \\ | \\ CH_2-OOC-nC_{11}H_{23} \end{array}$$

It is apparent from Table 2 that all samples No. 11 to No. 18 have the same composition in their upper layers, but samples of the invention (No. 12 to No. 18) showed much excellent resistances, although they vary according to the quantities and sizes of the powdery particles contained in the lower layers of the protective layers thereof, against pressure marks due to abrasion as compared to the comparative sample (No. 11). However, in the case where the mean particle size of the powdery particles contained in the lower layer of the protective layer is too small (sample No. 12), the effect of the present invention is detracted, while where the mean particle size is excessively large (sample No. 18), the transparency of the sample becomes unsatisfactory.

EXAMPLE 3

The following layers were coated on a subbed triacetate film base in the order from the base side.

First Layer

An antihalation layer containing black colloidal silver (with a dry thickness of 1μ).

Second Layer

A red-sensitive silver iodobromide emulsion layer (silver iodobromide emulsion containing 8 mole% of silver bromide, in a dry thickness of 6μ) containing, per mole of silver halide, $6.8\times10^{-2}$ moles of 1-hydroxy-N-{γ-(2,4-di-tert-amylphenoxy)-butyl}2-naphthoamide as a cyan coupler, $1.7\times10^{-2}$ moles of 1-hydroxy-N-{δ-(2,4-di-tert-amylphenoxy)-butyl}-4-(2-ethoxy-carbonyl-phenylazo)-2-naphthoamide as a colored coupler, and $4\times10^{-3}$ moles of 2-(1-phenyl-5-tetrazolylthio)-4-(2,4-di-tert-amylphenoxyacetamido)-1-indanone as a development inhibitor releasing substance.

Third Layer

A green-sensitive, low-speed, silver iodobromide emulsion layer (silver iodobromide emulsion containing 8 mole% of silver iodide, in a dry thickness of 3.5μ) containing, per mole of silver halide, $5.8\times10^{-2}$ of 1-(2,4,6-trichloro)phenyl-3-[3-(2,4-di-tert-amylphenoxy)acetamido]benzamido-5-pyrazolone as a magenta coupler, $1.7\times10^{-2}$ moles of 1-(2,4,6-trichlorophenyl)-3-[3-(octadecenylsuccinimido)-2-chloro]anilido-4-(γ-naphthyl-azo)-5-pyrazolone as a colored coupler, and $7\times10^{-3}$ moles of 2-(1-phenyl-5-tetrazolylthio)-4-(2,4-di-tert-amylphenoxy-acetamido)-1-indanone as a development inhibitor releasing substance.

Fourth Layer

A green-sensitive, high-speed, silver iodobromide emulsion layer (silver iodobromide emulsion containing 6 mole% of silver iodide in a dry thickness of 2.5μ) containing, per mole of silver halide, $1.1\times10^{-2}$ moles, $5\times10^{-3}$ moles, and $2\times10^{-2}$ moles of the same magenta coupler, colored coupler and development inhibitor releasing substance as in the third layer, respectively.

Fifth Layer

A gelatin layer (in a dry thickness of 1μ) containing yellow colloidal silver and 2,5-di-tert-octylhydroquinone.

Sixth Layer

A blue-sensitive silver iodobromide emulsion layer (silver iodobromide emulsion containing 7 mole% of silver iodide, in a dry thickness of 6μ) containing, per mole of silver halide, 350 g of gelatin, $3\times10^{-1}$ moles of α-pivaloyl-α-(1-benzyl-2-phenyl-3,5-dioxotriazolidine-4-yl)-5'-[α-(2,4-di-tert-amyl-phenoxy)butylamido]-2'-chloroacetanilide as an yellow coupler, and 1,2-bis(vinyl-sulfonyl)ethane as a hardener.

Seventh Layer

The lower layer of protective layers, having the composition as given in Table 3, containing 1,2-bis(vinyl-sulfonyl)ethane as a hardener and saponin as a coating aid.

Eighth Layer

The upper layer of protective layers, having the composition as given in Table 3, containing the same sliding agent as in Example 2, 1,2-bis(vinyl-sulfone)ethane as a hardener, and sodium di-2-ethyl-hexylsulfosuccinate as a coating aid, and silica with a mean particle size of 3.5μ as a matting agent.

The results of the obtained film samples tested for pressure marks due to abrasion are as given in Table 3.

TABLE 3

| Sample No. | | 19 | 20 | 21 | 22 | 23 | 24 | 25 | 26 | 27 |
|---|---|---|---|---|---|---|---|---|---|---|
| Protective Layer Composition | | | | | | | | | | |
| Upper layer | Binder (gelatin) g/m² | 1.40 | 1.10 | 0.80 | 0.60 | | | 0.60 | | |
| | Sliding agent g/m² | 0.12 | 0.10 | 0.07 | 0.04 | | | 0.04 | | |
| Lower layer | Binder (gelatin) g/m² | 0.80 | 1.10 | 1.40 | 1.60 | | | 1.60 | | |
| | Powdery particles | Polymethyl methacrylate | | | | | | $SiO_2$ | | |
| | Mean particle | | 0.5μ | | | | 0.1μ | | 1.0μ | |

TABLE 3-continued

| Sample No. | 19 | 20 | 21 | 22 | 23 | 24 | 25 | 26 | 27 |
|---|---|---|---|---|---|---|---|---|---|
| size (μ) of powdery particles | | | | | | | | | |
| Amount of powdery particles g/m² | | 0.20 | | | 0.10 | 0.10 | 0.20 | 0.05 | 0.05 |
| Dispersed liquid A | — | — | — | — | — | 0.32 | — | 0.32 | — |
| Test results | | | | | | | | | |
| Thickness of the upper layer (μ) | about 1.2 | about 0.9 | about 0.7 | about 0.6 | | | about 0.5 | | |
| Thickness of the lower layer (μ) | about 0.6 | about 0.9 | about 1.1 | about 1.2 | | | about 1.3 | | |
| Load to cause pressure marks due to abrasion (g) | 4 | 6 | 13 | 13 | 18 | 17 | 19 | 15 | 16 |

It is apparent from Table 3 that of the samples (No. 19 to No. 22) where the thickness of the upper and lower layers of the protective layers are varied, the samples of the present invention (No. 21 and No. 22), although they contain larger amounts of the sliding agent, are markedly excellent in the resistance against pressure marks due to abrasion as compared with the other samples (No. 19 and No. 20).

As also apparent from Examples 1 and 2, even in the samples (No. 23 to No. 27) wherein the particle sizes and quantities of the powdery particles in the compositions of the lower layers of the protective layers thereof are varied, the effect of the present invention, although slightly varied, are remarkably excellent.

What is claimed is:

1. A silver halide photographic light-sensitive element having on a support thereof, at least one silver halide light-sensitive emulsion layer, said at least one emulsion layer having thereon a protective layer composed of a binder containing a non-light-sensitive hydrophilic colloid, said protective layer comprising an outer layer and an inner layer between said outer layer and said at least one emulsion layer, said outer layer consisting essentially of oil particles in the form of water-insoluble liquid droplets finely dispersed in said binder at a volume of 0.1 to 0.4 based on the volume of the binder, said inner layer consisting essentially of fine solid particles selected from the group consisting of a copolymer of an ester of acrylic acid or of methacrylic acid, cellulose acetate propionate, polystyrene, silver halide, strontium sulfate, barium sulfate, calcium carbonate, $SiO_2$, ZnO, $TiO_2$, $Al_2O_3$, MgO, and BaO wherein the ratio of the thickness of the inner layer to the outer layer at least 1.5.

2. The light-sensitive element of claim 1, wherein the oil particles are selected from the group consisting of esters, amides, ethers, alcohols and paraffins.

3. The light-sensitive element of claim 2, wherein the oil particles are in the form of a solid at room temperature and in the form of a liquid when dispersed in said binder, said oil particles being selected from the group consisting of stilbene, triazine, oxazole, coumarin, benzotriazole, triazolin, and cinnamic acid ester.

4. The light-sensitive element of claim 1, wherein said fine solid particles are composed of $SiO_2$.

5. The light-sensitive element of claim 1, wherein the oil particles have an average particle diameter of 0.1μ to 2μ.

6. The light-sensitive element of claim 5, wherein the oil particles have an average particle diameter of 0.1μ to 1μ.

7. The light-sensitive element of claim 1, wherein the solid particles have an average particle diameter of 0.005μ to 5μ.

8. The light-sensitive element of claim 7, wherein the solid particles have an average particle diameter of 0.02μ to 3μ.

9. The light-sensitive element of claim 1, wherein the ratio of the thickness of the inner layer to the outer layer is from 1.5 to 4.

10. The light-sensitive element of claim 9, wherein the ratio of the thickness of the inner layer to the outer layer is from 1.5 to 3.

11. The light-sensitive element of claim 5, wherein the solid particles have an average particle diameter of 0.005μ to 5μ.

12. The light-sensitive element of claim 11, wherein the ratio of the thickness of the inner layer to the outer layer is from 1.5 to 4.

13. The light-sensitive element of claim 12, wherein the oil particles are selected from the group consisting of esters, amides, ethers, alcohols and paraffins.

14. The light-sensitive element of claim 12, wherein the oil particles are in the form of a solid at room temperature and in the form of a liquid when dispersed in said binder, said oil particles being selected from the group consisting of stilbene, triazine, oxazole, coumarin, benzotriazole, triazolin, and cinnamic acid ester.

15. The light-sensitive element of claim 13, wherein said fine solid particles are composed of $SiO_2$.

16. The light-sensitive element of claim 14, wherein said fine solid particles are composed of $SiO_2$.

17. The light-sensitive element of claim 1, wherein the amount of said solid particles is 3 to 50% by weight based on the weight of said non-light-sensitive hydrophilic colloid.

18. The light-sensitive element of claim 12, wherein the amount of said solid particles is 3 to 50% by weight based on the weight of said non-light-sensitive hydrophilic colloid.

* * * * *